US005950051A

United States Patent [19]

Casella

[11] Patent Number: 5,950,051

[45] Date of Patent: Sep. 7, 1999

[54] ENCODING DEVICE FOR A MOVING WEB

[75] Inventor: James M. Casella, Webster, N.Y.

[73] Assignee: Xerox Corporation, Stamford, Conn.

[21] Appl. No.: 08/908,006

[22] Filed: Aug. 8, 1997

[51] Int. Cl.[6] ..... G03G 15/00

[52] U.S. Cl. ..... 399/164; 347/16; 399/165

[58] Field of Search ..... 399/36, 117, 162–167, 399/384; 347/4, 16, 104

[56] References Cited

U.S. PATENT DOCUMENTS

| | | | |
|---|---|---|---|
| 4,499,849 | 2/1985 | Tomita et al. | 399/164 |
| 4,657,370 | 4/1987 | Forbes, II et al. | 399/165 |
| 4,686,540 | 8/1987 | Leslie et al. | 347/16 X |
| 4,986,526 | 1/1991 | Dastin . | |
| 5,075,702 | 12/1991 | Castelli et al. . | |
| 5,153,644 | 10/1992 | Yang et al. . | |
| 5,200,782 | 4/1993 | Castelli et al. . | |
| 5,200,791 | 4/1993 | Dastin et al. . | |
| 5,209,589 | 5/1993 | Bliss | 226/30 X |
| 5,229,787 | 7/1993 | Rees et al. . | |
| 5,294,069 | 3/1994 | Blahnik . | |
| 5,294,942 | 3/1994 | Loewenthal et al. | 347/16 X |
| 5,493,385 | 2/1996 | Ng . | |
| 5,510,877 | 4/1996 | deJong et al. . | |
| 5,537,190 | 7/1996 | Folkins et al. . | |
| 5,729,817 | 3/1998 | Raymond et al. | 399/384 |

FOREIGN PATENT DOCUMENTS

| | | |
|---|---|---|
| 61-085167 | 4/1986 | Japan . |
| 62-082699 | 4/1987 | Japan . |
| 62-133968 | 5/1987 | Japan . |
| 4-069666 | 2/1992 | Japan . |
| 4-278467 | 10/1992 | Japan . |
| 5-232129 | 9/1993 | Japan . |

*Primary Examiner*—Arthur T. Grimley
*Assistant Examiner*—Quana Grainger
*Attorney, Agent, or Firm*—Fay, Sharpe, Beall, Fagan, Minnich & McKee

[57] ABSTRACT

A device for encoding the position of a moving web, particularly a continuous photoreceptor belt in an electrophotographic printing apparatus, incorporates an encoding wheel for engaging an edge portion of the web, in combination with a long support member for supporting the remaining span of the web. Because the wheel is of a small width, the composite runout may be kept within acceptable limits for a lower cost compared to the long rollers of the prior art. The support member may include another roller for supporting the remaining span of the web or it may include a skid plate. The wheel can be manufactured within the required eccentricity and composite runout tolerances at a lower cost compared to prior art devices. The wheel can also be made with a larger diameter while the support roller can be of a compact construction to facilitate placement within the limited space in the printing device.

12 Claims, 2 Drawing Sheets

ENCODING DEVICE FOR A MOVING WEB

BACKGROUND OF THE INVENTION

The present invention relates to the art of encoding the movement of a web. More particularly, the invention relates to devices for encoding the motion of a photoreceptor belt in an electrophotographic, or xerographic printing apparatus.

The invention is particularly applicable to encoding the movement of a continuous photoreceptor belt in a multipass, multichromatic (multicolor) electrophotographic printing device and will be described with particular reference thereto. However, it will be appreciated that the invention has broader applications, such as encoding the position of a moving web in environments besides those that involve electrophotographic printing.

Electrophotographic printing involves the use of a photoconductive member that is initially charged to a substantially uniform potential. An electrostatic latent image is formed on the photoconductive member, usually by way of a raster output scanner (ROS), which discharges the charged photoconductive member in selected areas. The latent image is then developed by bringing a developer material, typically a toner powder, into contact with the surface. The developed image is then transferred to a copy sheet and permanently affixed thereto by fusing in a heating device.

In multicolor printing, a plurality of images are recorded and developed on the photoconductive member, which usually takes the form of a continuous belt. Typically, a four-color image requires a separate image for each of four colors, i.e., black, cyan, magenta, and yellow, which are recorded on the photoreceptor belt and later superimposed to form a single image on the recording medium.

In single pass color printing, the color separations are superimposed on the photoreceptor belt before being transferred to the recording medium. The photoreceptor belt thus makes only a single pass to acquire and develop the latent images for each of the color separations and transfers a multicolor image to the recording medium in a single operation.

In multipass color printing, one color separation is imaged and developed on the photoreceptor belt and transferred to the recording medium before the next color separation is imaged, developed and transferred. Thus, each color separation is transferred to the recording medium before the next one is developed, imaged and transferred. Thus, the photoreceptor belt makes multiple passes to transfer a given multiple color image to a sheet of the recording medium.

Both single and multipass color printing require precise control of the photoreceptor belt and its interaction with the imaging, developing and transfer stations of the printing apparatus in order to achieve the correct registration between the color separations and to avoid any image degradation. The motion of the photoreceptor belt must be accurately controlled, especially in the span of the belt which encompasses the imaging and developing stations. The positional accuracy required for acceptable registration in the trade is typically below a maximum limit of 125 micrometers. Some imaging techniques require registration accuracy of no more than 15 micrometers between color separations for pictorial information.

Various devices and systems for controlling and synchronizing photoreceptor belt motion are known. For example, U.S. Pat. No. 5,200,782 discloses a color printing device which utilizes an encoding roller to track the motion of the photoreceptor belt. The encoder provides belt motion and registration information to a servomechanism that controls the belt drive roller. The encoder can also provide motion information to the writing heads that generate the latent images on the belt. Similarly, U.S. Pat. No. 5,200,791 discloses a color registration system that utilizes an encoder roller to provide a clocking signal for controlling color registration. U.S. Pat. No. 5,153,644 discloses a xerographic system which incorporates an encoder wheel on the photoreceptor belt. The wheel is situated on the top of the photoreceptor belt and a backing roller is provided on the underside of the belt to support the same. The encoder wheel is positioned at one edge of the belt.

Encoder rollers typically comprise an elongate roller that extends across and engages the span of the photoreceptor belt. The roller shaft is connected to an encoding device that generates an electronic encoder signal corresponding to the roller rotation and belt speed. In order for the encoder signal to accurately control the belt speed, the roller eccentricity and composite runout must be kept within very strict tolerances. Eccentricity refers to the variation between the rotational center and the geometric center of the roller. Composite roller runout refers to the overall variation in eccentricity across the length of the roller. Since the roller speed control system operates in closedloop fashion to maintain encoder roller angular velocity constant, roller eccentricity and runout result in small variations, or modulations, in the linear velocity of the PR belt. This will contribute ultimately to registration errors.

Some known electrophotographic printing devices incorporate an encoder roller that operates synchronously with the photoreceptor belt. The belt length is selected as an integer multiple of the encoder roller circumference such that, ideally, the encoder roller is in the same phase orientation with every once-around of the photoreceptor belt. In such devices, the roller runout must be carefully controlled in order to maintain synchronous operation and keep color registration within acceptable limits. Acceptable composite runout tolerances are typically within ±0.05 mm. On a long roll, such tolerances become difficult to maintain and result in increased manufacturing costs. Thus, providing a low cost encoder roller with acceptable accuracy has heretofore presented a problem.

Applicants have found that, in printing devices, especially multipass architectures which use a synchronous encoder roller and photoreceptor belt, roller diameter and eccentricity are the two largest contributors to process direction misregistration. It is advantageous to provide an increased roller diameter with minimal eccentricity and composite runout. However, space limitations within most printing devices prevent the use of large diameter encoder rollers. This is typically due to the presence of other hardware beneath the belt span. Thus, providing an encoding device that accomplishes the aforementioned objectives has heretofore presented a problem.

SUMMARY OF THE INVENTION

The present invention contemplates a new and improved device for encoding the position of a moving web, particularly a moving photoreceptor belt, which overcomes all of the above reference problems and others and provides an encoding device with improved accuracy which is simple in its construction and economical to manufacture. In accordance with the present invention, there is provided an encoding device that includes an encoding wheel for engaging a portion of the web, in combination with a long support member for supporting the remaining span of the web.

Because the wheel is of a small width, the composite runout may be kept within acceptable limits for a lower cost compared to the long rollers of the prior art. The support member may comprise another roller or a skid plate for supporting the remaining span of the web.

In accordance with a more limited aspect of the invention, there is provided an encoding device having an encoder wheel of a large diameter to improve the registration errors in printing devices utilizing a synchronous photoreceptor belt and encoder roller.

Still, other advantages and benefits of the invention will become apparent to those skilled in the art upon a reading and understanding of the following detailed description.

BRIEF DESCRIPTION OF THE DRAWINGS

The invention may take physical form in certain parts and arrangements of parts a preferred embodiment of which will be described in detail in this specification and illustrated in the accompanying drawings which form a part hereof, wherein.

DETAILED DESCRIPTION OF THE PREFERRED EMBODIMENT

Figure 1:
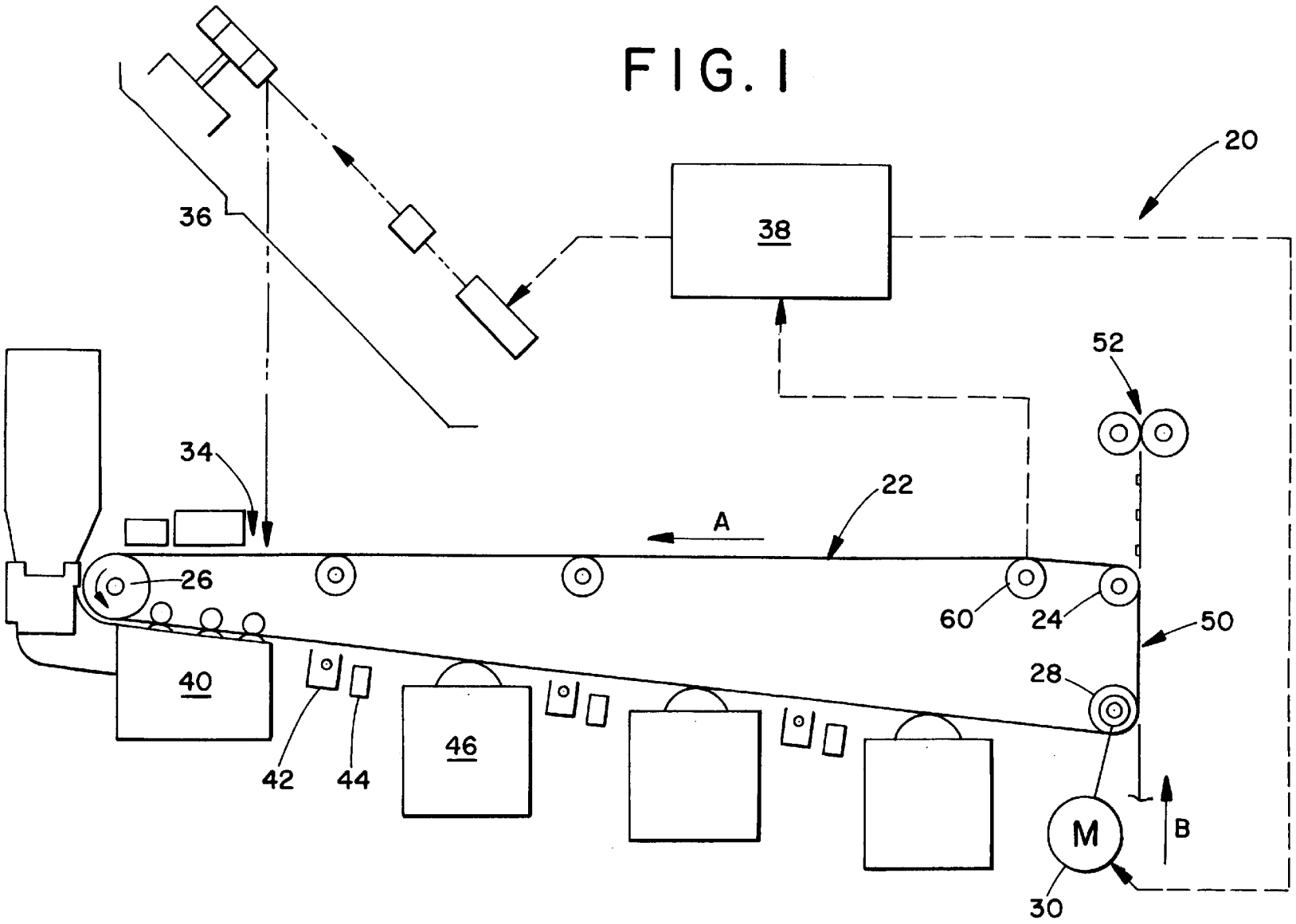
FIG. 1 is a schematic diagram illustrating an electrophotographic printing apparatus according to the present invention.

Referring now to the drawings wherein the showings are for the purposes of illustrating the preferred embodiment of the invention only and not for purposes of limiting the same, the figures show an electrophotographic printing apparatus having an encoder roller assembly according to the present invention.

Referring to FIG. 1, an electrophotographic printing apparatus 20, suitable for practicing the present invention is illustrated. This particular arrangement is suitable for a recharge-and-develop type printing technique, which is described in detail in U.S. Pat. No. 5,337,190, the subject matter of which is incorporated herein by reference. It will be recognized that the advantages of the present invention will apply to other electrophotographic printing techniques, and any other apparatus which incorporates a moving printing belt or web.

Photoreceptor belt 22 is entrained around a pair of tension rollers 24 and 26, and a drive roller 28 which is coupled to motor 30. The outside surface of belt 22 contains a charge retentive material. Belt 22 travels in the direction of arrow A, the process direction, and first encounters a corona charge device 32, where the charge retentive surface is charged to a uniform potential. The belt surface is then exposed to a latent image at imaging station 34, which may include a laser Raster Output Scanner (ROS) 36. The latent image is formed as the ROS, according to instructions from controller 38, scans across the moving belt to expose and discharge selected areas of belt 22. In a typical copying process, the discharged areas correspond to background, i.e., non-text or blank areas on the original document.

The latent image is developed as the selectively discharged areas of belt 22 move past developing station 40, which typically provides a black toner to the charged areas. The belt then moves past a second recharge device 42 and a second imaging device 44 to provide a second latent image on belt 22. The second latent image is superimposed on the already developed black image on the belt and developed at developer station 46 with a first color toner, i.e., yellow. In a similar manner, third and fourth recharge and development stations (not numbered) provide respective latent images in two other colors, typically magenta, and cyan, respectively. Belt 22 is thus provided with a four-color image. The four-color image is transferred to a recording medium, i.e., a blank sheet of paper, which is conveyed in contact with the belt 22 in the direction of arrow B at transfer station 50. A fuser assembly 52 applies heat to the recording medium to fuse the toner particles thereto.

Encoder roller 60 is positioned adjacent belt 22 to engage the inside surface thereof. An electronic signal, corresponding to the movement of belt 22, is conveyed to controller 38, which produces a control signal for drive motor 30 to maintain a constant belt speed. Control signals are also provided to imaging device 36 and to second, third and fourth recharge and developing stations.

Figure 2:
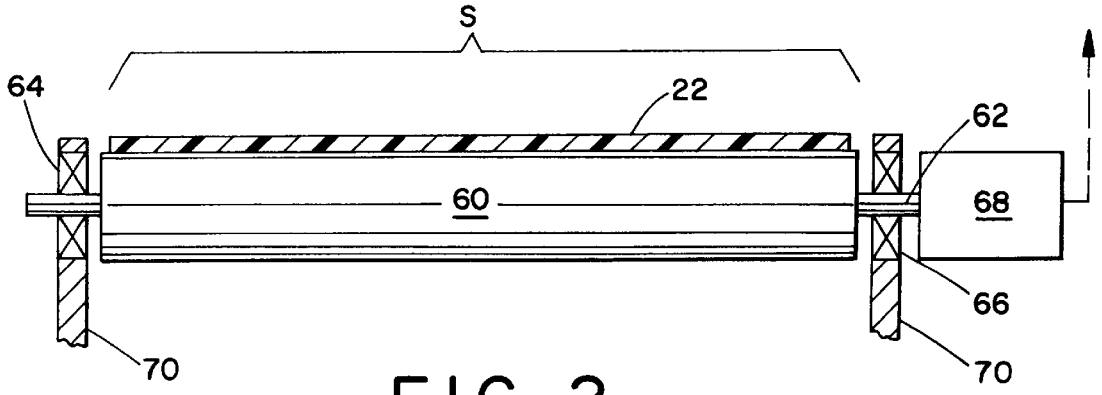
FIG. 2 (PRIOR ART)
FIG. 2 is an illustration of an encoder roller according to the prior art.

FIG. 2 is a front view of a known encoder roller configuration. Encoder roller 60 extends beneath the entire span S of belt 22 which moves in a process direction that is outward from the page. Roller 60 includes a shaft which is journalled at opposite ends in bearings 64 and 66. Bearings 64 and 66 are secured to the frame 70 of the printing device. One end of shaft 62 is connected to a known encoder 68, which includes the necessary circuitry for converting the rotational motion of shaft 62 into an electronic signal.

Figure 3:
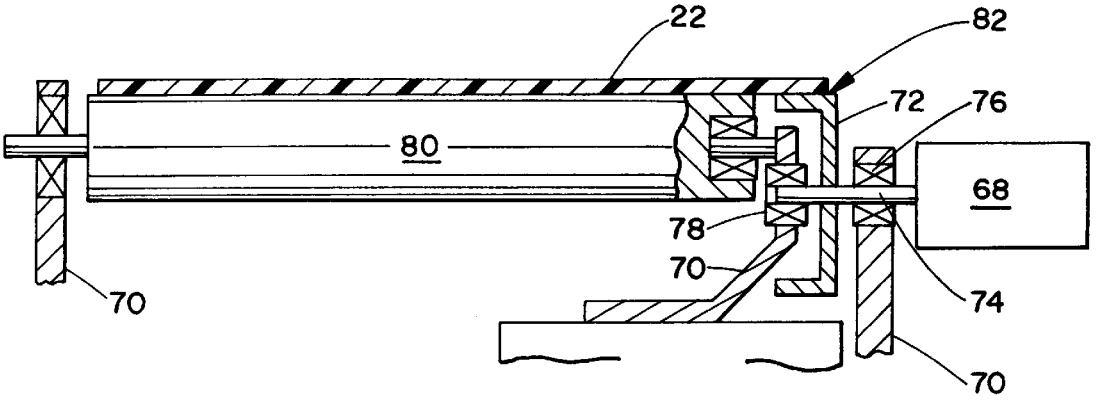
FIG. 3 is an illustration of an encoder roller assembly according to a preferred embodiment of the present invention.

FIG. 3 illustrates an encoder roller configuration according to a preferred embodiment of the invention. An encoding wheel 72 is provided adjacent the inside surface of belt 22 for movement therewith. Wheel 72 is fixed to shaft 74, which is journalled in bearings 76 and 78, both fastened to frame 70 which provides general support for the components of the printing apparatus. The end of shaft 74 opposite wheel 72 is connected to encoder circuit 68. In accordance with the invention, a belt support member, shown in the form of a roller 80 is provided for supporting the span of belt 22 that is not engaged by wheel 72. Wheel 72 is mounted with respect to roller 80 such that the circumferential surface 82 of wheel 72 is flush with the circumferential surface of roller 80 along the line where both surfaces engage belt 22. Encoding wheel 72 is of a larger diameter than support roller 80. It will be appreciated that wheel 72 may be constructed of any suitable material that provides the necessary frictional contact with belt 22 and which maintains the required eccentricity during operation. It will also be appreciated that belt support roller 80 may be manufactured with larger tolerances and, accordingly, at a lower cost.

Figure 4:
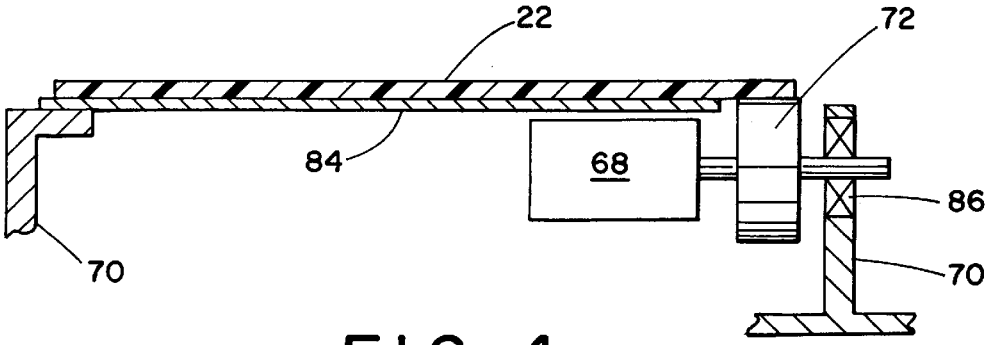
FIG. 4 is an illustration of an encoder roller according to another preferred embodiment of the present invention.

FIG. 4 illustrates another preferred embodiment of the invention wherein the belt support member takes the form of a skid plate 84 which is fixed to frame 70 and positioned to provide support to belt 22. In this embodiment, encoding wheel 72 is mounted in cantilever fashion inboard of frame 70 via bearing 86. Skid plate 84 offers the advantage of a low profile support member that permits inboard mounting of encoder 68 and wheel 72.

It will be recognized that the invention provides certain advantages over the prior art. For example, since the encoder wheel is of a larger diameter than prior art devices, the effect of wheel eccentricity on registration is reduced because the wheel makes a lower number of revolutions per belt revolution. Moreover, since the wheel is of a shorter width than prior art devices, the effective eccentricity or composite runout of the roll may be more closely controlled at a lower cost than for prior art rollers, thus achieving an overall economic advantage without sacrificing performance. The invention also offers the advantage of reduced drag on the photoreceptor belt.

The invention has been described with reference to the preferred embodiments. Obviously, modifications and alterations will occur to others upon a reading and understanding of the specification. For example, the concept of the present invention are also applicable to printing techniques involving more than four-color printing and to retrofit of existing apparatus. It is intended to include all such modifications and alterations so far as they come within the scope of the appended claims or the equivalents thereof.

Having thus described the invention, what is claimed is:

1. An apparatus for encoding movement of a web that moves in a longitudinal direction along a web path and has a dimensional web span measured in a direction substantially perpendicular to the longitudinal direction, comprising:

a frame;

an encoding wheel rotatably mounted with respect to the frame, for supporting and engaging a portion of the span of the web at a preselected location along the web path;

a support member mounted on the frame and including a surface for supporting a remaining portion of the web span at the preselected location along the web path so that a width of the encoding wheel and support member support the span of the web; and an encoder, operatively associated with the wheel, for generating a signal corresponding to the movement of the wheel.

2. The apparatus according to claim 1, wherein the support member comprises a skid plate.

3. The apparatus according to claim 1, wherein the support member comprises a support roller.

4. The apparatus according to claim 3, wherein a diameter of the encoding wheel is larger than a diameter of the support roller.

5. The apparatus according to claim 3, wherein the encoding wheel has composite runout that is less than a composite runout of the support roller.

6. The apparatus according to claim 3, a wherein a circumferential surface of the encoding wheel is flush with a circumferential surface of the support roller.

7. An electrophotographic printing apparatus for producing copies of an original document comprising:

a frame;

a continuous photoreceptor belt, mounted for movement with respect to the frame, for receiving and developing a latent image thereon as the belt advances in a process direction, the belt having an inner surface, and a span measured in a direction substantially perpendicular to the process direction;

an encoder assembly for generating a signal corresponding to the movement of the photoreceptor belt, the encoder assembly comprising:

a wheel engaging a portion of the span along the inner surface of the belt at a preselected location and mounted to said frame for rotational movement with respect thereto;

an encoder operatively associated with the wheel for generating a signal corresponding to the movement thereof;

a support member positioned adjacent the wheel at the preselected location and mounted to the frame supporting a remaining portion of the span of the belt so that a width of the wheel and support member are selected to support an entire belt span.

8. The apparatus according to claim 7, wherein the support member comprises a skid plate.

9. The apparatus according to claim 7, wherein the support member comprises a support roller.

10. The apparatus according to claim 9, wherein a diameter of wheel is larger than a diameter of the support roller.

11. The apparatus according to claim 9, wherein the wheel has composite runout that is less than a composite runout of the support roller.

12. The apparatus according to claim 9, wherein a circumferential surface of the wheel is flush with a circumferential surface of the support roller.

* * * * *